United States Patent [19]

Antill

[11] 4,230,489

[45] Oct. 28, 1980

[54] ALLOYS OF Fe, Cr, Si, Y AND Al

[75] Inventor: John E. Antill, Didcot, England

[73] Assignee: United Kingdom Atomic Energy Authority, London, England

[21] Appl. No.: 29,841

[22] Filed: Apr. 13, 1979

[30] Foreign Application Priority Data

Apr. 28, 1978 [GB] United Kingdom ..... 17063/78

[51] Int. Cl.[3] ..... C22C 39/02

[52] U.S. Cl. ..... 75/124

[58] Field of Search ..... 75/124, 126 G, 126 Q

[56] References Cited

U.S. PATENT DOCUMENTS

| | | | |
|---|---|---|---|
| 2,580,171 | 12/1951 | Hagglund et al. | 75/124 |
| 2,635,164 | 4/1953 | Rehnqvist et al. | 75/124 |
| 3,027,252 | 3/1962 | McGurty et al. | 75/124 |
| 3,298,826 | 1/1967 | Wukusick | 75/126 G |
| 3,852,063 | 12/1974 | Niimi et al. | 75/126 C |

FOREIGN PATENT DOCUMENTS

| | | | |
|---|---|---|---|
| 40-7660 | 4/1965 | Japan | 75/124 |

*Primary Examiner*—M. J. Andrews

*Attorney, Agent, or Firm*—Larson, Taylor and Hinds

[57] ABSTRACT

Certain alloys of iron, chromium, aluminium and yttrium are known e.g. from U.S. Pat. No. 3,027,252 and from U.K. Pat. No. 1,045,993 and are stated to be high temperature, oxidation resistant alloys.

The invention relates to alloys of iron, chromium, aluminium and yttrium containing additionally certain proportions of silicon. Thus, the alloys of the invention comprise from 15 to 25% Cr, 4 to 5.5% Al, 0.01 to 3% Y, 0.3 to 5% Si and the balance Fe, where all proportions are by weight. The corrosion resistance of the alloys increases as the percentage of Si increases to reach a peak at about 1% Si. The preferred range of Si is 0.5 to 2%. All proportions are by weight.

1 Claim, No Drawings

ALLOYS OF FE, CR, SI, Y AND AL

IMPROVEMENTS IN OR RELATING TO ALLOYS

This invention relates to alloys of iron, chromium, aluminium, yttrium and silicon.

Certain alloys of iron, chromium, aluminium and yttrium are known. Thus, U.S. Pat. No. 3,027,252 describes alloys of the following composition: 20.0 to 95.0 weight percent chromium, 0.5 to 4.0 weight percent aluminium, 0.5 to 3.0 weight percent yttrium and the balance iron. These alloys are stated to be high temperature, oxidation resistant alloys with improved workability and an improved oxide film. Also, U.K. Pat. No. 1,045,993 (corresponding to U.S. Pat. No. 3,298,826) describes an alloy of iron, aluminium and yttrium which consists of less than 20 weight percent chromium, an amount in the range of from 0.5 to 12 weight percent aluminium, 0.1 to 3.0 weight percent yttrium and the balance iron. Such an alloy is stated to be resistant to embrittlement at certain temperatures and to retain a high degree of resistance to oxidation and corrosion. Alloys with greater than 20 weight percent chromium are stated in U.K. Pat. No. 1,045,993 to be subject to embrittlement. Alloys with levels of yttrium at lower levels are stated to lose their oxidation resistance.

We have now devised alloys of iron, chromium, aluminium and yttrium, which contain, additionally, certain proportions of silicon, and found that such alloys may, in certain experimental tests, exhibit greater corrosion resistance as the proportion of silicon in the alloy is increased.

The present invention provides, in a first aspect an alloy of iron, chromium, aluminium, yttrium and silicon which comprises from 15 to 25 weight percent of chromium, from 4 to 5.5 weight percent of aluminium, from 0.01 to 3 weight percent of yttrium, from 0.3 to 5 weight percent of silicon, and the balance iron.

Such alloys have significant corrosion resistance as evidenced by tests we have carried out on representative alloys and which are described in the examples of this specification. The alloys of our invention may therefore have application, for example, as supports for motor vehicle exhaust catalysts and as resistance heating elements.

It should be noted that the aforementioned known alloys will, in all probability, have contained small proportions of incidental silicon. Such proportions are to the best of our knowledge, however, less than the lower limit of the Si range in our alloys (0.3 weight percent) and do not, in any event, give rise to the advantageous properties of the alloys of our invention. We prefer, however, that the lower limit of the Si range is 0.5 weight percent.

The upper limit of the Si range in our alloys (5 weight percent) is probably dictated by embrittlement considerations, in that high proportions of Si are likely to make the alloys brittle. Generally, though 2 weight percent of silicon represents a preferred upper limit on embrittlement grounds. Thus, the preferred alloys of our invention have from 0.5 to 2 weight percent of silicon within which from 1 to 2 weight percent of silicon is particularly preferred.

The alloys of the invention may be made by methods known in the art for making alloys of iron, chromium, aluminium and yttrium.

The alloys of the invention may be fabricated into usable forms by means of conventional techniques such as reduction of ingots by forging, roll clogging, extrusion, drawing and/or rolling. For example, the alloys may readily be fabricated in the form of strip.

The alloys of our invention may also contain unspecified incidental ingredients such as may be introduced in or accompanying the process of alloy manufacture, for example in accordance with common steel-making processes, and do not materially effect the characteristics of the alloy.

The invention will now be particularly described, by way of example only, in Examples 1 to 8 wherein all proportions are by weight. A comparison of the results of Examples 2 and 6 with those of Examples 1, 3, 4, 5, 7 and 8 shows that corrosion resistance is improved as the proportion of silicon in the alloy is increased.

The general procedure was to take samples of Fe/Si, Cr, Al and Y in the desired proportions, with a little excess of Y to account for losses thereof, and arc melt them together to give an alloy in the form of a button weighing several hundred grams. The bottom was then rolled into a sheet. (The loss of Y is caused by it forming a slag on the surface of the alloy).

A number of alloys was prepared in the above manner. Their compositions are given in the table below.

| Example | Y | Cr | Al | Si | Other |
|---|---|---|---|---|---|
| 1 | 0.30 | 15.7 | 4.8 | 0.35 | Co 0.8 |
| 2 | 0.32 | 15.0 | 4.6 | 1.14 | |
| 3 | 0.36 | 15.3 | 4.8 | 0.5 | |
| 4 | 0.36 | 16.1 | 5.1 | 0.58 | |
| 5 | 0.40 | 19.7 | 4.6 | 0.34 | |
| 6 | 0.43 | 15.2 | 4.6 | 1.13 | |
| 7 | 0.45 | 15.3 | 4.7 | 0.31 | |
| 8 | 0.51 | 15.5 | 4.9 | 0.31 | |

Samples of the above alloys in the form of foil 50 μm thick were tested for corrosion resistance by heating in motor vehicle exhaust gases at 1085° C. The results are summarised in the table below where the corrosion resistance is indicated in terms of the 'life' of sample, assessed by visual examination. "Failure" is characterised by local complete oxidation of the foil section. The life is the time taken (in hours) for the area of failed foil to exceed 1 $mm^2$.

| Example | Life (hours) |
|---|---|
| 1 | 600, 770 |
| 2 | >1300 |
| 3 | 870, 1200 |
| 4 | 740 |
| 5 | 1350, 1600 |
| 6 | >2150 |
| 7 | 330, 460, 600 |
| 8 | 710, 1600 |

I claim:

1. An alloy of iron, chromium, aluminium, yttrium and silicon consisting of from 15 to 25 weight percent of chromium, from 4 to 5.5 weight percent of aluminium, from 0.01 to 3 weight percent of yttrium, from 1 to 2 weight percent of silicon, and the balance iron.

* * * * *